US006591806B2

(12) United States Patent
Asano et al.

(10) Patent No.: US 6,591,806 B2
(45) Date of Patent: Jul. 15, 2003

(54) JOINT FASTENING STRUCTURE FOR AN AUTOMOTIVE POWER PLANT FASTENING PORTION

(75) Inventors: Masayuki Asano, Saitama (JP); Satoshi Fukuoka, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/971,714

(22) Filed: Oct. 9, 2001

(65) Prior Publication Data

US 2002/0050263 A1 May 2, 2002

(30) Foreign Application Priority Data

Oct. 11, 2000 (JP) ..... 2000-310093
Jun. 21, 2001 (JP) ..... 2001-188111

(51) Int. Cl.[7] ..... F02F 7/00
(52) U.S. Cl. ..... 123/195 R
(58) Field of Search ..... 123/195 R, 195 C

(56) References Cited

U.S. PATENT DOCUMENTS 4,280,453 A * 7/1981 List et al. ..... 123/195 R
4,467,754 A * 8/1984 Hayashi et al. ..... 123/195 R
4,470,379 A * 9/1984 Miyakoshi et al. ..... 123/195 R
4,955,343 A * 9/1990 Ogami ..... 123/195 R
5,231,894 A 8/1993 Okita et al. ..... 74/606
5,669,346 A * 9/1997 Leweux et al. ..... 123/195 R
6,070,563 A * 6/2000 Achenbach et al. .... 123/195 R
6,101,995 A * 8/2000 Itoh et al. ..... 123/195 R
6,223,712 B1 * 5/2001 Montgomery ..... 123/195 R

FOREIGN PATENT DOCUMENTS

EP 0-525-967 A1 2/1993
EP 0-901-924 A1 3/1999

* cited by examiner

*Primary Examiner*—Henry C. Yuen
*Assistant Examiner*—Jason Benton
(74) *Attorney, Agent, or Firm*—Armstrong, Westerman & Hattori, LLP

(57) ABSTRACT

There is provided a joint fastening structure which is commonly used as a fastening portion of an internal combustion engine main body and a transmission case and a fastening portion of the internal combustion engine main body and an accessory, wherein a threaded component passes through the transmission case and the internal combustion engine main body so as to be integrally fastened to internal threads in the accessory.

8 Claims, 3 Drawing Sheets

JOINT FASTENING STRUCTURE FOR AN AUTOMOTIVE POWER PLANT FASTENING PORTION

BACKGROUND OF THE INVENTION

1. Field of the Invention

The present invention relates to a joint fastening structure for an automotive power plant fastening portion in which an accessory is jointly fastened to the fastening portion.

2. Description of the Related Art

In a conventional power plant in which a transmission is integrally connected to an end face of an internal combustion engine on an output shaft end side, since an accessory needs to be disposed within a predetermined narrow space in an engine compartment, the accessory is secured to the housing at a portion of the internal combustion engine main body which is contiguous with the transmission with threaded components such as bolts and screws, and the housing is fastened to the cylinder block with threaded components. In addition, the cylinder block and the transmission case are fastened together with threaded components.

In a mounting structure as described above, however, since the fastening portion where the accessory is mounted on the housing and the fastening portion where the housing is mounted on the internal combustion engine main body interfere with each other, there is caused a drawback that the disposition of the accessory is limited whereby the degree of freedom in layout of the accessory is reduced.

SUMMARY OF THE INVENTION

The present invention relates to an improved automotive power plant fastening portion which has overcome the difficulty, and according to a first aspect of the invention, there is provided a joint fastening structure for an automotive power plant fastening portion which is commonly used as a fastening portion of an internal combustion engine main body and a transmission case and a fastening portion of said internal combustion engine main body and an accessory, the joint fastening structure being characterized in that a threaded component passes through the transmission case and the internal combustion engine main body so as to be integrally fastened to internal threads in the accessory.

According to the first aspect of the invention, with the aforesaid structure, since the threaded component is inserted from the transmission case side, the internal combustion engine main body and the transmission case can easily be fastened together without being influenced by the mounting configuration of the accessory to the housing and the other accessories.

In addition, since the accessory is jointly fastened to the internal combustion engine and the transmission which constitute the automotive power plant with the threaded component which integrally combines the internal combustion engine with the transmission, the fastening man-hours and number of fastening components can be reduced, and this leads to reduction in cost.

In addition, according to a second aspect of the invention, portions at which the threaded component passes through the transmission case and the internal combustion engine main body are flanges. According to the construction of the second aspect of the invention, since the flange portions of the internal combustion engine main body and the transmission case are highly rigid, in addition to the advantage provided by the first aspect of the invention, there is provided an advantage that the fastening strength can be increased.

Furthermore, according to a third aspect of the invention, the threaded component is disposed in the vicinity of a mating surface between the cylinder block and the oil pan. According to the construction of the third aspect of the invention, since the threaded component for use in attaching the accessory is allowed to pass through the highly rigid portion in the vicinity of the mating surface between the cylinder block and the oil pan, in addition to the advantages provided in accordance with the first and second aspects of the invention, there is further provided an advantage that the fastening strength of the accessory relative to the internal combustion engine main body and the transmission case can further be increased.

In addition, while the accessory itself tends to be heated by virtue of heat conducted from the cylinder block of the internal combustion engine, according to a fourth aspect of the invention, a cooling water pipe member communicating with a radiator is disposed along the vicinity of the accessory. Thus, in addition to the advantages provided in accordance with the first, second and third aspects of the invention, there is provided an advantage that the accessory can be cooled by cooling water to thereby improve the durability since the temperature of the cooling water passing through the interior of the cooling water pipe member is lower than that of the accessory.

DETAILED DESCRIPTION OF THE PREFERRED EMBODIMENTS

An embodiment of the invention illustrated in FIGS. 1 to 3 will be described below.

Figure 1:
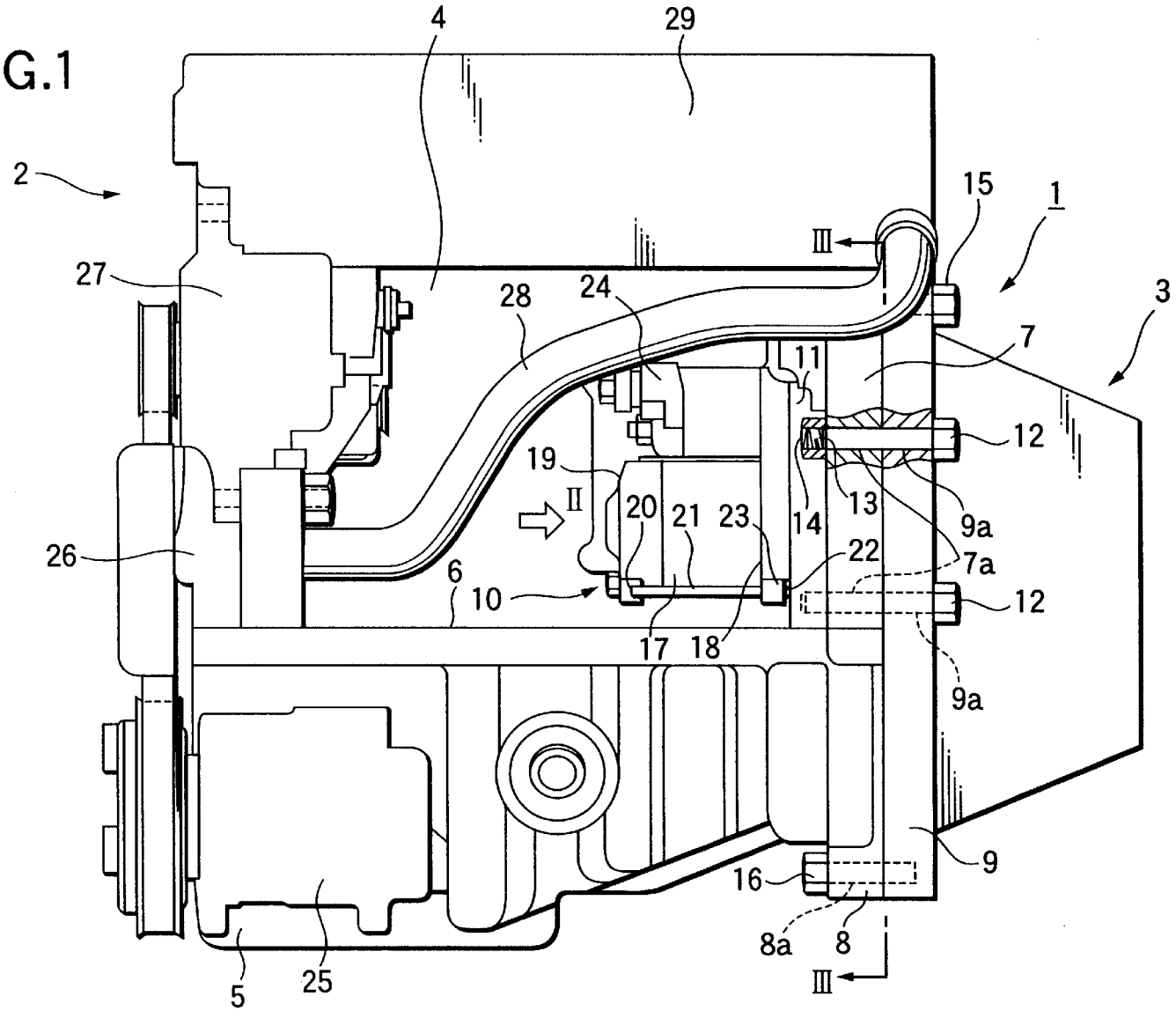
FIG. 1 is a side view of an embodiment of the invention.

An automotive power plant 1 mounted at a front portion of a vehicle body of a passenger car, not shown, is an in-line four-cylinder four-stroke-cycle engine with DOHC (double overhead camshafts), and as shown in FIG. 1, the automotive power plant 1 comprises an internal combustion engine 2 and a transmission 3. In a main body of the internal combustion engine 2, a cylinder block 4 and an oil pan 5 are brought into abutment with each other at a mating surface 6, an upper surface of the cylinder block 4 and a lower face of a cylinder head 29 are brought into abutment with each other. The cylinder block 4, the oil pan 5 and the cylinder head 29 are combined with each other with bolts or stud bolts which are not shown.

In addition, an end face of a flange 9 of a case of the transmission 3 is brought into abutment with end faces (right end faces as viewed in FIG. 1, or portions of FIG. 3 where many dots are provided and many doted lines are caused to intersect with each other) of a flange 7 of the cylinder block 4 and a flange 8 of the oil pan 5. A housing flange 11 of a starter motor 10 is brought into abutment with the other end face (a left end face as viewed in FIG. 1) of the flange 7 of the cylinder block 4. Then, a distal externally threaded portion 13 of a bolt 12 passing through a bolt hole 9*a* in the flange 9 of the transmission 3 and a bolt hole 7*a* in the flange 7 of the cylinder block 4 from right to left is fastened into an internally threaded hole 14 in the housing flange 11 of the starter motor 10, whereby the transmission 3, the cylinder block 4 and the starter motor 10 are constructed so as to be integrally jointly fastened together with the bolt 12.

Figure 2:
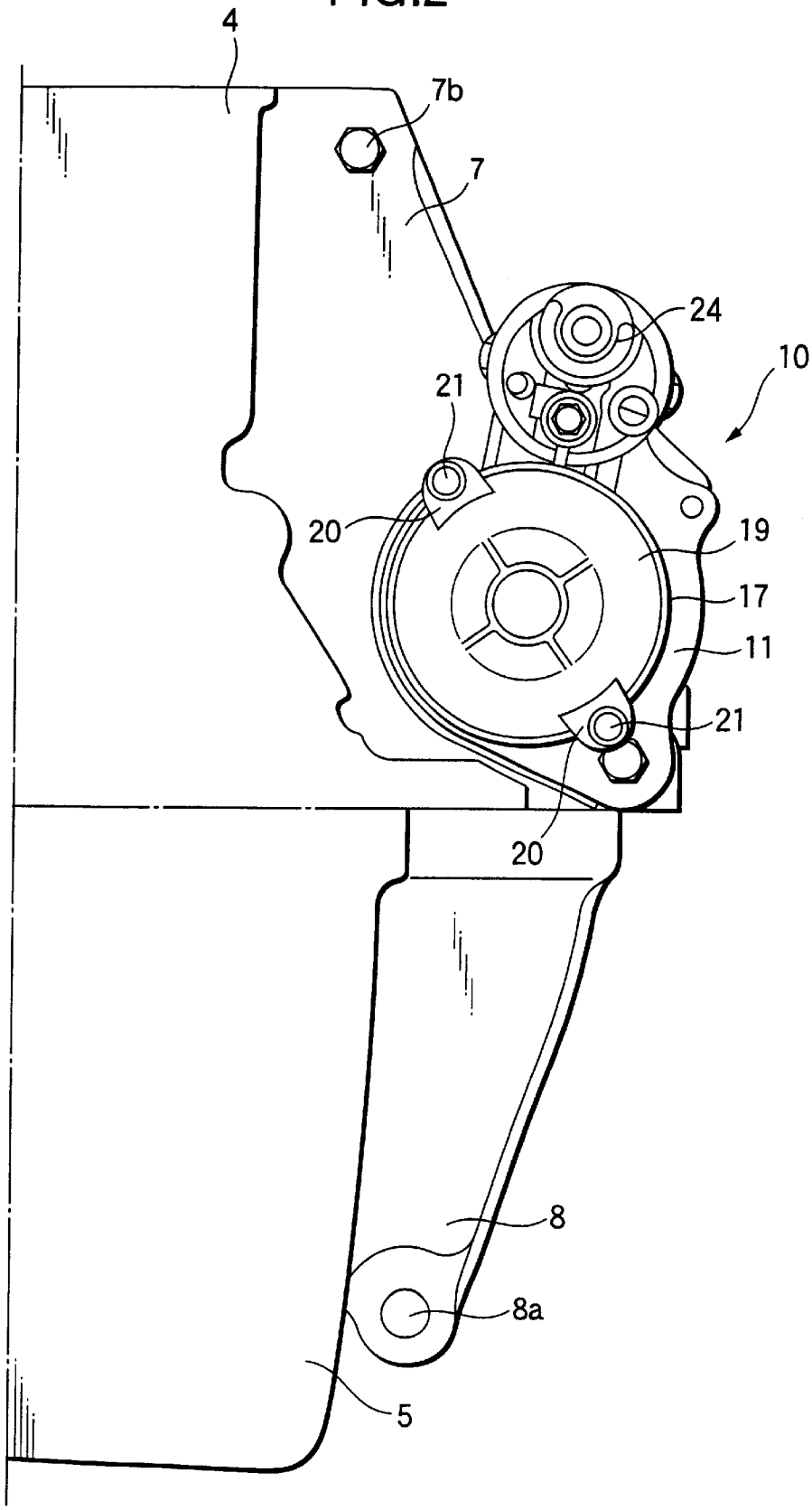
FIG. 2 is a view as seen in a direction indicated by an arrow II in FIG. 1.
Figure 3:
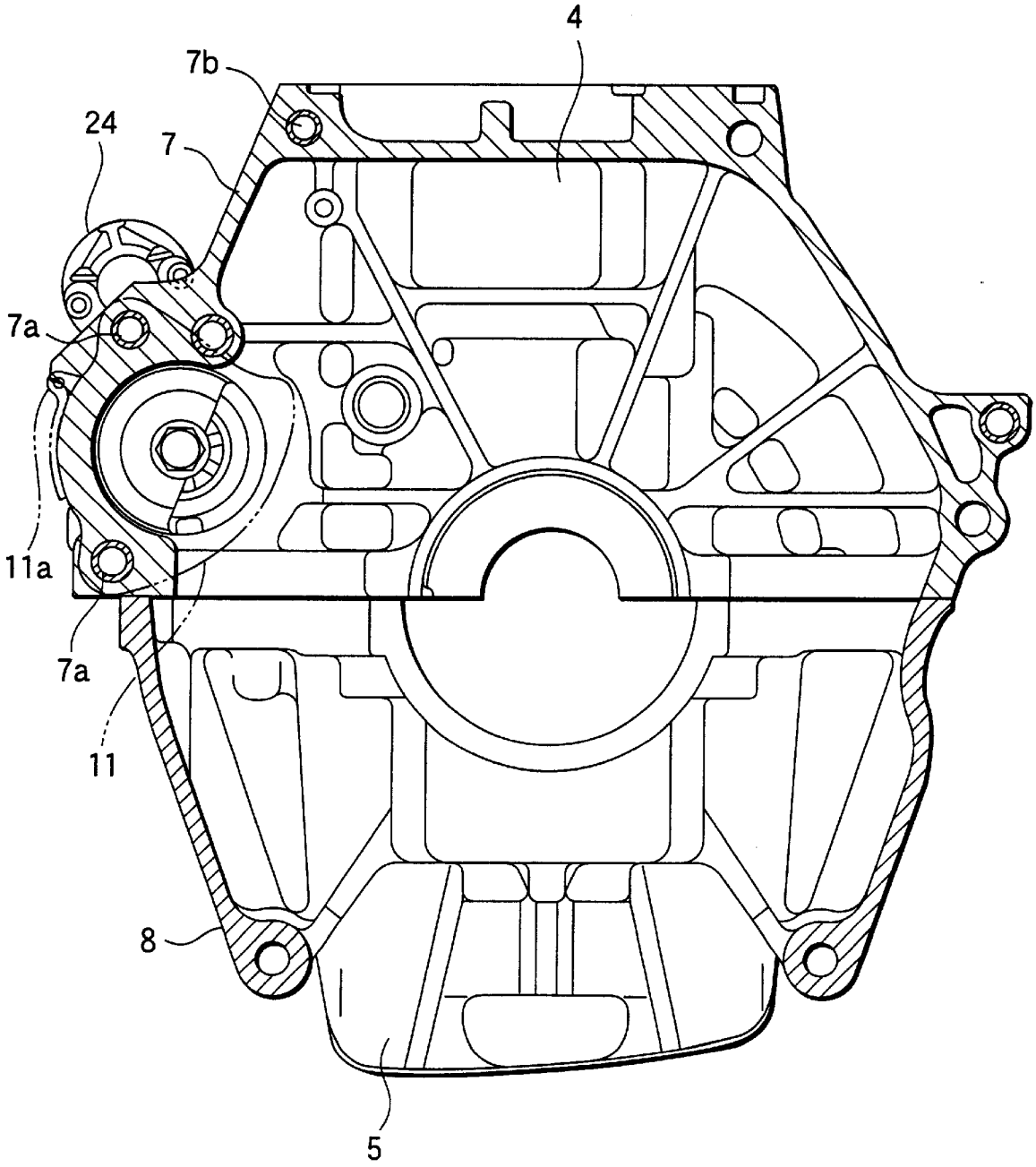
FIG. 3 is a view taken along the line III—III in FIG. 1.

Furthermore, as shown in FIG. 1, a bolt 15 passes through an upper portion of the flange 9 of the case of the transmission 3 from right to left to be fastened into a bolt hole 7*b* in an upper portion of the flange 7 of the cylinder block 4 (refer to FIGS. 2 and 3). And, a bolt 16 passes through a bolt hole 8*a* in a lower portion of the flange 8 of the oil pan 5 (refer to FIGS. 2 and 3) from left to right to be fastened into a lower portion of the flange 9 of the case of the transmission 3. Bolts, not shown, other than but similar to the bolt 15 or bolt 16 are fastened along the full circumference of the transmission 3 at required intervals.

Moreover, as shown in FIG. 1, the housing flange 11 of the starter motor 10 is brought into abutment with a bottom portion 18 of a main body 17 of the starter motor 10 from left, and as shown in FIG. 2, protruding lugs 20 are integrally provided on a top portion 19 of the main body 17 of the starter motor 10 diametrically across the center of the main body 17. Then, as shown in FIG. 1, an externally threaded portion 22 of a machine screw 21 passing through the protruding lug 20 from left to right is fastened into an internally threaded portion 23 of the housing flange 11 of the starter motor 10.

Moreover, as shown in FIG. 2, a magnet switch 24 is integrally assembled the main body 17 of the starter motor 10.

In addition, as illustrated in FIG. 1, an air conditioner compressor 25 is integrally mounted on the cylinder block 4 at a position below the lower surface of the cylinder block 4 on a left end side thereof with a mounting member, not shown. And, a cooling water pump 26 is integrally mounted on the cylinder block 4 with a mounting member, not shown, at a position above the air conditioner compressor 25 and on this side of the cylinder block 4 as viewed in FIG. 1. Further, an ACG 27, which is an alternate current generator, is integrally mounted on the cylinder block 4 with a mounting member, not shown, at a position above the cooling water pump 26. The cooling water pump 26 and an upper right-hand side portion (as viewed in FIG. 1) of the cylinder block 4 are connected to each other via a cooling water pipe 28 so as to provide a communication therebetween, the cooling water pipe 28 being a cooling water pipe member which connects to a radiator, not shown.

The embodiment illustrated in FIGS. 1 to 3 is constructed as described above, and at the position where the starter motor 10 is mounted on the cylinder block 4, the housing flange 11 of the starter motor 10 is integrally jointly fastened to the flange 7 of the cylinder block 7 and the flange 9 of the transmission 3 with the bolts 12 which pass through the bolt hole 9*a* in the flange 9 of the transmission 7 and the bolt hole 7*a* in the flange 7 of the cylinder block 4 from right to left as viewed in FIG. 1 to be fastened into the internally threaded hole 14 in the housing flange 11 of the starter motor 10. Therefore, the cylinder block 4 and the transmission 3 need to be fastened together with no other bolt, whereby the fastening man-hours and number of fastening bolts can be reduced, this leading to reduction in production costs.

Furthermore, since the bolt 12 is fastened from the transmission 3 side toward the cylinder block 4 side of the internal combustion engine 2, the fastening work of the bolt 12 can easily be implemented without any interference with the starter motor 10, the magnet switch 24 and the cooling water pipe 28.

Moreover, while the starter motor 10 tends to be heated to a high temperature when receiving heat from the cylinder block 4 which is heated to a high temperature and heat from the atmosphere within the engine compartment, since the temperature of the cooling water in the cooling water pipe 28 is lower than the temperatures of the cylinder block 4 and the starter motor 10 irrespective of the running condition of the internal combustion engine 2, the starter motor 10 is cooled by the cooling water running through the cooling water pipe 28, the durability being thereby increased.

While only certain embodiments of the invention have been specifically described herein, it will apparent that numerous modifications may be made thereto without departing from the spirit and scope of the invention.

What is claimed is:

1. A joint fastening structure for an automotive power plant fastening portion, which is used as a fastening portion of an internal combustion engine main body and a transmission case and a fastening portion of said internal combustion engine main body and an accessory, wherein a threaded component passes through said transmission case and said internal combustion engine main body so as to be integrally fastened to an internal thread in said accessory.

2. The joint fastening structure for an automotive power plant fastening portion as set forth in claim 1, wherein portions at which said threaded component passes through said transmission case and said internal combustion engine main body are flanges.

3. The joint fastening structure for an automotive power plant fastening portion as set forth in claim 1, wherein said threaded component is disposed in the vicinity of a mating surface between said cylinder block and said oil pan.

4. The joint fastening structure for an automotive power plant fastening portion as set forth in claim 1, wherein a cooling water pipe member communicating with a radiator is disposed along the vicinity of said accessory.

5. A joint fastening structure for an automotive power plant fastening portion, comprising:

an internal combustion engine main body defining a first fastening portion;

a transmission case connected to said internal combustion engine main body and defining a second fastening portion;

an accessory connected to said internal combustion engine main body, said accessory defining an internal thread; and a threaded component passing through said first and second fastening portions and fastened to said internal threads of said accessory.

6. The joint fastening structure for an automotive power plant fastening portion as set forth in claim 5, wherein said transmission case and said internal combustion engine main body respectively include flanges formed with said first and second fastening portions.

7. The joint fastening structure for an automotive power plant fastening portion as set forth in claim 5, wherein said threaded component is disposed in the vicinity of a mating surface between said cylinder block and said oil pan.

8. The joint fastening structure for an automotive power plant fastening portion as set forth in claim 5, wherein a cooling water pipe member communicating with a radiator is disposed along the vicinity of said accessory.

* * * * *